US005361502A

United States Patent [19]

Derwin

[11] Patent Number: 5,361,502

[45] Date of Patent: Nov. 8, 1994

[54] SANITARY DRUM AND CAN OPENING DEVICE

[76] Inventor: Louis A. Derwin, 4830 E. 82nd St., Newaygo, Mich. 49337

[21] Appl. No.: 120,734

[22] Filed: Sep. 14, 1993

[51] Int. Cl.[5] ..... B67B 7/50

[52] U.S. Cl. ..... 30/431; 30/429

[58] Field of Search ..... 30/429, 430, 431, 432, 30/413; 83/630, 632, 633

[56] References Cited

U.S. PATENT DOCUMENTS

| | | | |
|---|---|---|---|
| 1,560,397 | 11/1925 | Perl et al. | 30/431 |
| 1,935,680 | 11/1933 | Wolfersdorf | 30/417 |
| 3,088,203 | 5/1963 | Perl | 30/430 |
| 3,941,021 | 3/1976 | Meinholdt | 83/633 X |

FOREIGN PATENT DOCUMENTS

| | | | |
|---|---|---|---|
| 313197 | of 1929 | United Kingdom | 30/430 |

*Primary Examiner*—Rinaldi I. Rada

*Assistant Examiner*—Kenneth E. Peterson

*Attorney, Agent, or Firm*—Francis C. Kowalik; John J. Kowalik

[57] ABSTRACT

A drum deheader device comprising a pair of mounting bars for respectively supporting a shearing blade and an opposing anvil adapted to be positioned at opposite sides of a can cover portion of a chime and a linkage interconnecting said bars to advance and retract the bars for cutting and releasing the device, the linkage being formed and arranged to cut the chime twice as the operating levers are moved back and forth toward and away from each other, the blade being positioned to cut through an upper section of an outer layer only of the chime and to expose an inner layer of the chime beneath the shear blade which has a wedge face which slides on the exposed portions of the inner layer of the chime to separate the layers apart, thereby loosening a cover from the container and forming a continuous strip of scrap material whereby sliver forming is inhibited.

14 Claims, 2 Drawing Sheets

SANITARY DRUM AND CAN OPENING DEVICE

BACKGROUND OF THE INVENTION

This invention is directed to a deheader for opening a can or drum.

Conventional devices separate the end panel closure from a drum by cutting the end panel of the closure about its periphery. The panel is offset inwardly into the can body and is integrally formed with a cylindrical flange which extends from the periphery of the end panel to the adjacent end of the drum body. Debris, which is collected at the juncture or corner formed between the end panel and flange, is dumped into the contents of the can as the end panel is removed. Also as the closure is being cut at this juncture, slivers of metal are invariably produced which with any dirt or other debris drop into the food in the drum and thus contaminate the product within the drum.

Discussion of the Prior Art

The following patents have been found in a prior art search:

U.S. Pat. No. 1,360,256 illustrates a roller cutter embracing opposite sides of the edge portion of the sealed can in which the cutter cuts through the chime and the body portion of the can conventionally;

U.S. Pat. No. 1,935,680 illustrates a rotary cutter wheel which cuts through the head against another rotary cutter;

U.S. Pat. No. 2,618,054 shows a rotary cutter cutting through a pressure disk against the upper edge of a can while the rotary cutter cuts the side of the can;

U.S. Pat. No. 3,510,941 shows a cutter engaging the chime at its out side and a rotary drive wheel engaging the inside;

U.S. Pat. No. 4,604,806 shows a drive wheel cooperating with a rotary cutter which cuts through an outside layer of the chime.

SUMMARY OF THE INVENTION

An object of this invention is to provide a cutter which comprises opposed shear and anvil which are lever-activated toward each other and arranged to cut off an upper portion of a bight of a chime and leaving enough overhang of the upper edge of the bight to prevent the cover from dropping into the drum. This eliminates slivers and leaves enough leftover metal to allow forming of a ring larger than the diameter of the chime and drum.

A further object of the invention is to provide opposed shear and anvil members which are arranged to impose a vertical force vector on the chime which provides a lifting force on the cover as the cutter progresses around the chime, thus loosening the cover particularly in the area of engagement of the inner flange against the inside of the container so as to facilitate removal of the cover from the drum body.

A principal object is to provide a novel cutter having opposed anvil and shear blade arranged to cut off a bight portion of a chime in such location and manner that a continuous strip of scrap is produced exposing the upper portion of the container edge so that the cover with its flange is biased to lift off the container body and the production of slivers is virtually eliminated. In the unlikely event of any slivers being produced, they are deposited on the cover panel.

Another object is to provide a cutter comprising a shear and anvil arranged to grasp an uppermost edge portion of the chime therebetween thus wedging it against an upper edge portion of the can body to loosen the cover with portions of the chime flange to facilitate removal of the cover.

A different object is to provide a cutter with opposing blade and anvil which act to scalp an upper bight portion of a chime in a location radially outwardly of the cover flange larger than the diamter of the drum to prevent the cover from falling into the container. This is accomplished by leaving a portion of the bight overhanging the upper edge of the can end.

These and other objects of the invention will become more apparent from the specification and the drawing wherein, for the purpose of clarity, the several views are drawn to different scales, and:

DESCRIPTION OF THE INVENTION

Figure 1:
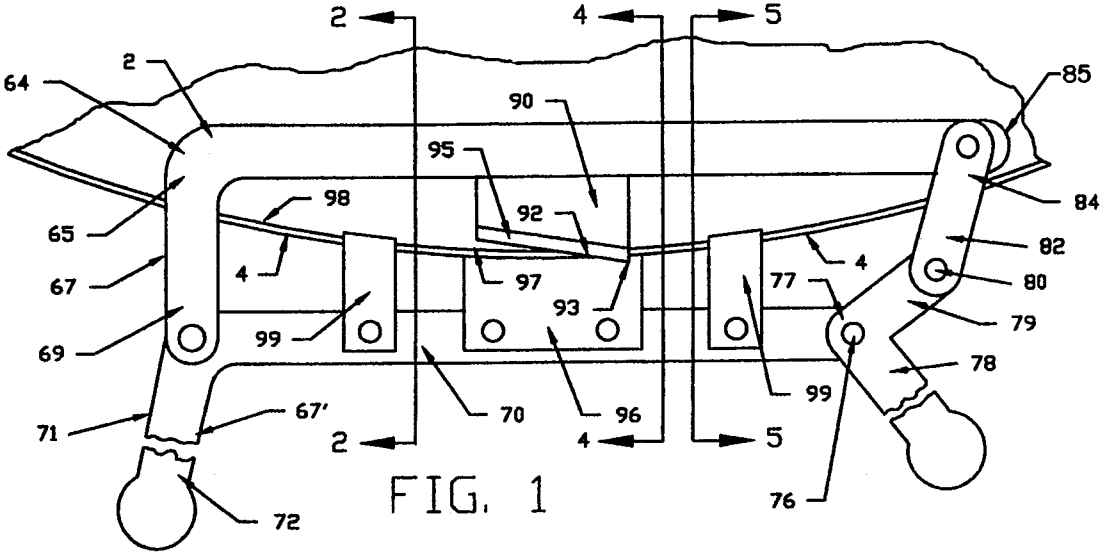
FIG. 1 is a top plan view of the novel cutter shown in association with a drum.
Figure 3:
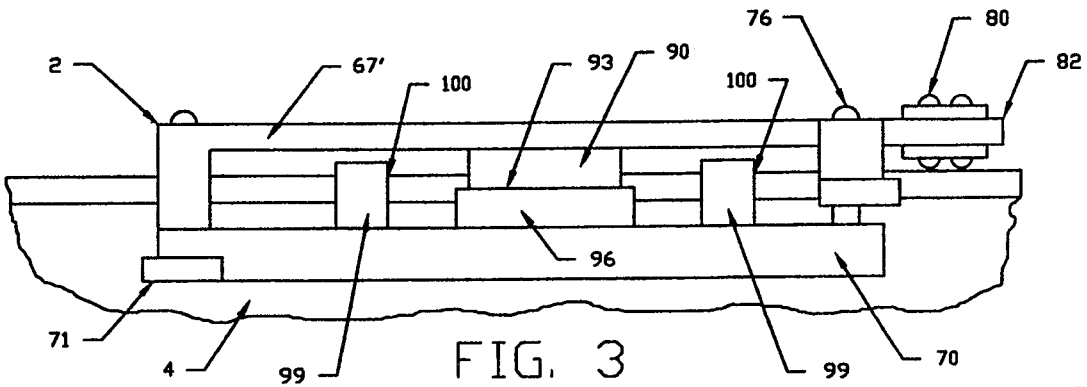
FIG. 3 is a side elevational view of one side of the cutter.
Figure 5:
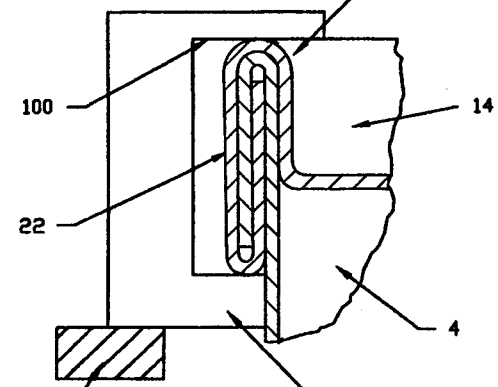
FIG. 5 is a vertical cross-section taken substantially on line 5—5 of FIG. 1.

Referring to the drawings, there is shown a cutter 2 in association with a steel drum 4 which comprises a cylindrical body 6 having bottom 8. It will be understood that a removal closure 10 usually is the same as shown at the upper end 12 of the drum of container. The terms "top" and "bottom" are used for orientation of the closure or cap 10 which comprises a horizontal flat end panel 13 and an integral peripheral annular axially extending flange 14 which tightly fits within the can portion of the cylindrical container body or shell 6.

The flange 14 merges at its upper end with an internal chime portion 20 of an upwardly convexed curved bight portion 22.

The bight or can hook or crown portion 22 merges into outer flange 24 which merges integrally into the upper end 25 of an outer flange or seaming wall 26 which extends downwardly and merges at its lower edge 31 into an upper edge 32 of an outer portion 34 of a lower bight portion 35 which is curved under the lower end 36 of an outer leg or flange 38 of the cover end portion.

The lower end of the flange 26 merges into the lower end 48 of an outer leg of flange 50. An upward curved or convexed bight 55 of the can body portion which has an upper face 54 complementally fitted into a downwardly open concave face 55' of the bight or crown portion 22. This type of chime construction is conventional as shown in U.S. Pat. No. 3,510,941.

The cutter described in association with the container has an L-shaped blade-supporting bar or leg 64 which extends chordally with reference to the can body 4 as shown in FIG. 1. The bar 64 is integrally connected at one end 65 to one end of a transverse extension arm 67.

The distal end 69 of crossbar 67 is pivotally connected to an arm 71. Member 67' is fixedly connected, as by welding, to one end of the anvil carrying bar 70. Bar 67 is pivotally connected to one end of a handle or lever member 72.

The free end of bar 70 is pivotally connected as by a pin 76 to an intermediate portion or elbow 77 of a handle lever arm 78. An inner end portion 79 of the lever arm 78 is pivotally connected as at 80 to one end of a motion transfer swing link 82 which is pivotally connected at its other end 84 to an adjacent end 85 of the leg member 66.

The leg member 64 mounts intermediate its ends a shear blade 90 which has a diagonal shear edge 92 terminating in a leading end piercing point 93. The shear edge 92 is beveled to form a ramp or wedging surface 95 sloping downwardly to a flat bottom face 93 of the blade.

The blade opposes an anvil 96 which is mounted on the leg 64 intermediate its ends. The anvil has a concave face 97 which seats against the complementary outer annular sector face 98.

Figures 4, 6, 7, 8, 9, 10, 11:
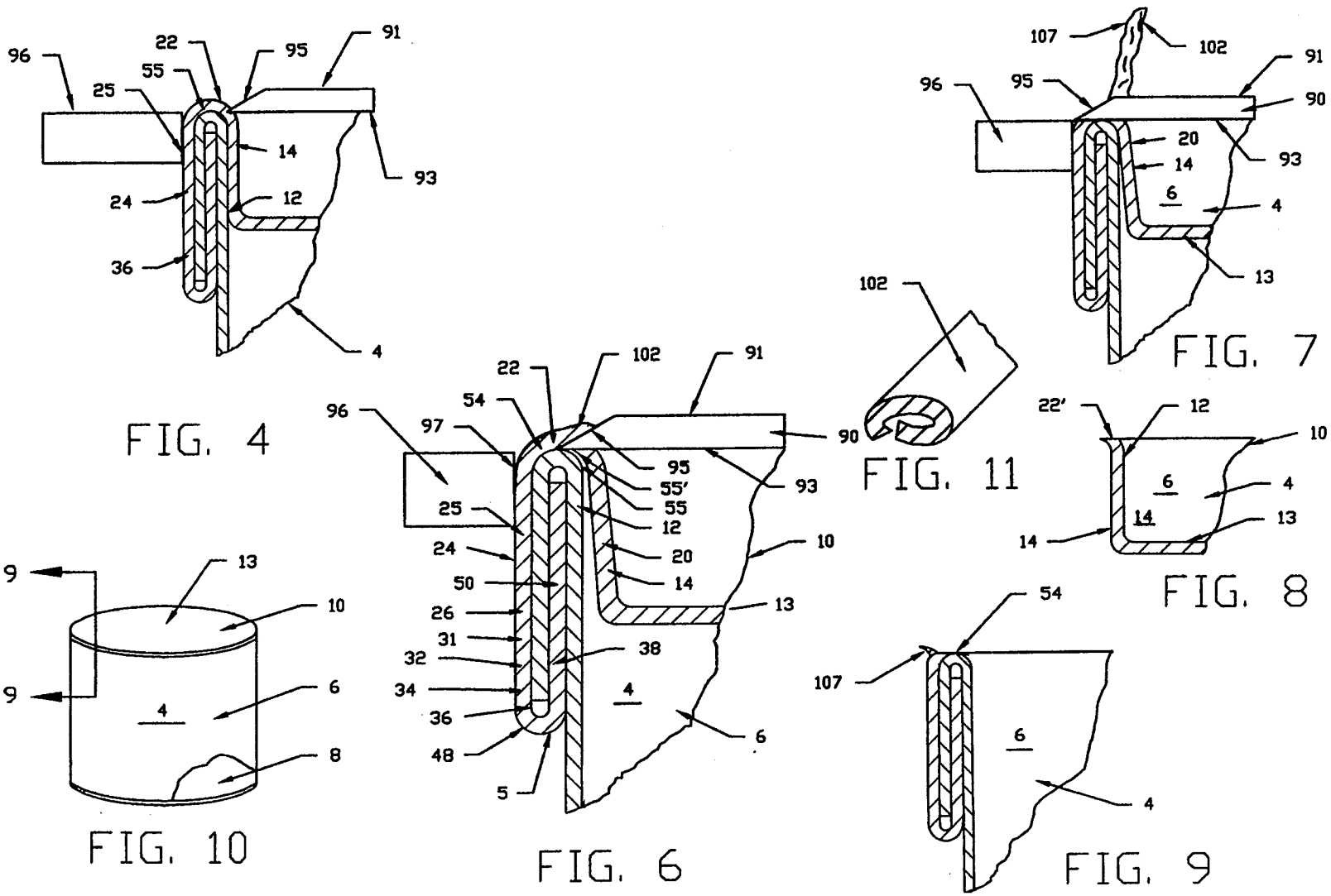
FIG. 4 is a vertical cross-section taken substantially on line 4—4 of FIG. 1.
FIG. 6 is an enlarged vertical cross-section taken generally on line 5—5 of FIG. 1 showing the chime after being partially cut.
FIG. 7 is a cross-section similar to FIG. 6 showing the chime cut further.
FIG. 8 is a partial cross-section of a cover portion.
FIG. 9 is a vertical cross-section after the tool is removed.
FIG. 10 is a perspective view of a closed drum.
FIG. 11 is a cross-section of the strip cutoff.

As seen in FIGS. 4 and 7, the blade as it progresses in cutting the bottom face 93, slides over the crest 22 and tugs against the cover flanges to loosen the it. Also only the outer flange is cut in contrast to the four flanges having to be cut by the prior art devices.

The leg 64 has a pair of guides 99,99 adjacent to opposite ends of the anvil which hook over the chime at the upper end of the can. The guides are provided with coplanar limit faces 100,100 which maintain the blade at a predetermined level such that the blade edge is adapted to cut through the inner flange portion 14 of the chime in the region below the bight portion of the inner portion of the chime which is in engagement with the flat face of the blade in cleaving relation thereto. As the outermost portion of the chime is being cut and the flat bottom face slides upon the lower or inner convex portion 22, the blade tends to lift the flange portion 4 which is part of the cover or lid and thus lifts the lid so as to loosen the cover which thus facilitates removal of the cover.

Also by cutting the exterior portion 22 of the chime, a maximum amount of the material of the flange of the cover is retained as shown at 22' so that it can be easily rolled into a bead thereby preserving the cover flange bead thereby preserving the cover flange so that it may be reused as a closure. By cutting only through the outer crown portion as seen in FIG. 8 less effort is required than when cutting through the four layers as done presently.

Figure 2:
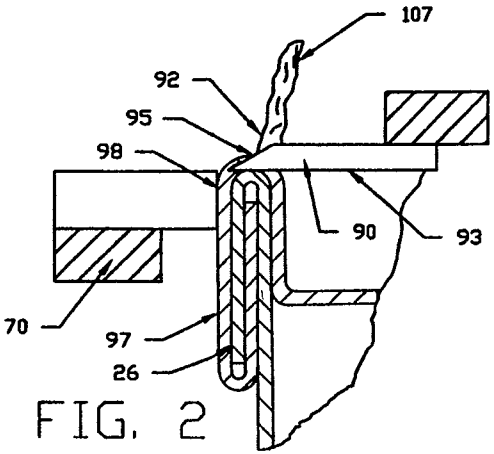
FIG. 2 is a fragmentary vertical cross-section taken substantially on line 2—2 of FIG. 1.

A strip 102 as seen in FIG. 2 of cut off material develops as seen in FIGS. 6 and 7. The cutting as done inhibits formation of slivers and if any develop, such slivers will fall into the cover, thus preventing contamination.

I claim:

1. A device for severing a can cover from the body of a can comprising:

first and second mounting bars pivotally interconnected at one of their corresponding ends to each other, operating means comprising a first lever fixed to said first bar for pivotal movement therewith, link means having one end pivotally connected to a second end of the first bar, a handle lever arm pivotally mounted intermediate its ends to a second end of said second bar and having one end pivotally connected to an other end of said link means, a shear blade mounted on the first bar, an anvil mounted on the second bar in scissor cutting relation with said blade, and guide means mounted on said first bar in overlapping relation to said second bar and engagement therewith to maintain said blade and anvil in shearing relation, said guide means hanging said device in a position disposing said blade in a horizontal position in engagement with a top edge of a container chime and rising vertically as the blade cuts through a portion of the chime and additionally tearing the chime, and said blade having a horizontally positioned edge and a wedge surface facing upwardly for sliding over a portion of the chime presently being cut.

2. The invention according to claim 1 and said device having a pair of levers, and means operatively interconnecting said blade and anvil to effect movement thereof toward and away from each other attendant to movement of said levers.

3. The invention according to claim 2 and said interconnecting means providing a linkage for relatively advancing said retracting said blade and anvil twice during maximum movement of said levers between extreme positions.

4. The invention according to claim 3 and said linkage operative to position said linkage being in a dead center position between opposite ends of the stroke of said other lever whereby disengaging the shear blade at each end of the stroke of said second lever to facilitate repositioning of said cutter to permit advancing of the cutter about the rim of the can.

5. The invention according to claim 4 and said device being formed and arranged to scalp an outer portion only to release a cover portion from portions of the chime therebelow.

6. The invention according to claim 1, and means locating said blade to shear only through an outermost portion of the chime.

7. The invention according to claim 5 and means for positioning said blade within said cover portion, and an anvil positioned against an external side portion of the can body portion.

8. The invention according to claim 1 and the pivotal connections of the link means being located to pass through a dead center position so as to intermittently cause the edge of the blade to cut twice in the same location as the device is manually advanced by sliding the device upon an uncut chime portion.

9. The invention according to claim 8 and said anvil having a concave contour for engaging the external side of the chime while said blade cuts through an inner side with the shear blade.

10. The invention according to claim 9 and said blade having a leading piercing point.

11. The invention according to claim 10 and said blade having a diagonal shearing edge.

12. The invention according to claim 4 and said anvil being contoured to complementally fit an external side of the chime.

13. The invention according to claim 4 and said blade having a flat bottom and a beveled top side sloping upwardly and forming a sharp shearing edge with said bottom side.

14. The opener according to claim 1 and said blade being operative to wedge said sections apart.

* * * * *